US011751632B2

(12) United States Patent
Ouchi et al.

(10) Patent No.: US 11,751,632 B2
(45) Date of Patent: Sep. 12, 2023

(54) SHOE

(71) Applicant: Shimano Inc., Osaka (JP)

(72) Inventors: Kaoru Ouchi, Osaka (JP); Toshiaki Aoki, Osaka (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 17/508,258

(22) Filed: Oct. 22, 2021

(65) Prior Publication Data

US 2022/0142303 A1 May 12, 2022

(30) Foreign Application Priority Data

Nov. 9, 2020 (JP) ..... 2020-186633

(51) Int. Cl.
*A43C 11/14* (2006.01)

(52) U.S. Cl.
CPC ..... *A43C 11/1493* (2013.01)

(58) Field of Classification Search
CPC ..... A43C 11/1493
USPC ..... 36/50.1
See application file for complete search history.

(56) References Cited

U.S. PATENT DOCUMENTS 5,659,982 A * 8/1997 Muraoka ..... A43B 5/14 36/131
6,272,772 B1 * 8/2001 Sherman ..... A43C 11/14 36/89
9,907,363 B2 * 3/2018 Smith ..... A43B 3/126
2008/0086910 A1 * 4/2008 Kim ..... A43C 11/1493 36/50.1
2016/0324257 A1 * 11/2016 Ko ..... A43B 13/145
2018/0116343 A1 * 5/2018 Hei ..... A43C 11/00
2018/0242692 A1 * 8/2018 Houng ..... A43C 11/1493
2018/0352904 A1 * 12/2018 Garzon ..... A43C 11/1493
2019/0313742 A1 * 10/2019 Bell ..... A43B 23/0245

FOREIGN PATENT DOCUMENTS

JP 8-140708 A 6/1996

* cited by examiner

*Primary Examiner* — Timothy K Trieu
(74) *Attorney, Agent, or Firm* — Global IP Counselors, LLP

(57) ABSTRACT

A shoe includes a shoe body, an elongated tightening member, at least one hook and an intermediate attaching member. The shoe body includes a sole and an upper mounted on the sole. The elongated tightening member has a first end, a second end and an intermediate part between the first end and the second end. The first end is attached to a first attaching position located on a front side of the upper. The second end is detachably attached to a second attaching position located rearward of the first end in the longitudinal direction of the upper. The hook is located rearward of the first attaching position and forward of the second attaching position, and enables the tightening member to be wound and hooked to the hook. The intermediate attaching member is configured to enable the intermediate part to be attached to the upper.

17 Claims, 13 Drawing Sheets

SHOE

CROSS-REFERENCE TO RELATED APPLICATIONS

This application claims priority to Japanese Patent Application No. 2020-186633, filed on Nov. 9, 2020. The entire disclosure of Japanese Patent Application No. 2020-186633 is hereby incorporated herein by reference.

BACKGROUND

Technical Field

The present disclosure generally relates to a shoe.

Background Information

Shoes are often provided with laces for tightening the shoe to a foot of a wearer. For example, Japanese Laid-Open Patent Publication No. H8-140708 discloses a shoe having a shoe strap for tightening the shoe to a foot of a wearer (see, FIG. 1 of this Japanese publication). In this Japanese publication, a shoe strap is configured to be laced through each of a plurality of eyelets of the shoe and folded back at each of the eyelets, followed by pulling a tail end of the laced shoe strap to tighten the shoe to a foot of a wearer.

The shoe of the above type enables adjustment of the tightening force of the shoe strap only by pulling the tail end of the shoe strap. In general, tightening forces suitable for the respective portions of the foot of the wearer (i.e., tightening positions of the shoe strap) differ from each other. However, the shoe strap configured as described above cannot adjust the tightening force according to each of the tightening positions. Thus, a fine adjustment of the tightening force to conform to the wearer's preference for wearing comfortableness could not be made by the above-configured shoe.

SUMMARY

Therefore, in view of the above circumstances, an object of the present disclosure is to provide a shoe that is able to easily adjust the tightening force according to the tightening position.

The following presents a simplified summary of the disclosure to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

According to one aspect of the present disclosure, a shoe is provided that basically comprises a shoe body, an elongated tightening member, at least one hook and an intermediate attaching member. The shoe body basically includes a sole and an upper mounted on the sole. The elongated tightening member has a first end, a second end and an intermediate part between the first end and the second end. The first end is attached to a first attaching position located on a front side of the upper. The second end is configured to be detachably attached to a second attaching position located rearward of the first end with respect to the longitudinal direction. The at least one hook is located rearward of the first attaching position and forward of the second attaching position. The at least one hook is configured to enable the tightening member to be wound and hooked to each of the at least one hook. The intermediate attaching member is configured to enable the intermediate part of the tightening member to be attached to the upper.

The shoe of the present disclosure can be configured such that the tightening member is a single tightening member.

The shoe of the present disclosure can be configured such that the intermediate attaching member is made up of a plurality of intermediate attaching members.

The shoe of the present disclosure can be configured such that the at least one hook is made up of a plurality of hooks located at attachment positions. The first attaching position, the arrangement positions, and the second attaching position are alternately aligned on a first side and a second side with a width center of the upper disposed between the first side and the second side. An arrangement path of the tightening member includes a front side arrangement section between the first attaching position of the first end and the arrangement position of the hook located at a foremost position among the plurality of hooks in the longitudinal direction, at least one intermediate arrangement section between two ones of the arrangement positions of the plurality of hooks, and a rear side arrangement section between the second attaching position of the second end and the arrangement position of the hook located at a rearmost position among the plurality of hooks in the longitudinal direction. The intermediate attaching member is arranged on at least one of the front side arrangement section, the intermediate arrangement section, and the rear side arrangement section.

The shoe of the present disclosure can be configured such that the at least one intermediate arrangement section includes an intermediate arrangement section that is adjacent to the front side arrangement section in the longitudinal direction. The intermediate attaching member is arranged on the intermediate arrangement section adjacent to the front side arrangement section.

The shoe of the present disclosure can be configured such that the at least one intermediate attaching member includes a first attaching part arranged on the upper, and a second attaching part arranged on the tightening member. The second attaching part is configured to be detachably attached to the first attaching part. The first attaching part is formed by any one of a male member and a female member of a hook-and-loop fastener. The second attaching part is formed by the other of the male member and the female member of the hook-and-loop fastener.

The shoe of the present disclosure can be configured such that the plurality of hooks includes at least three hooks. The at least one intermediate arrangement section of the arrangement path is made up of at least two intermediate arrangement sections. The intermediate attaching member is made up of a plurality of intermediate attaching members. Each of the plurality of intermediate attaching members is arranged on each of the at least two intermediate arrangement sections.

The shoe of the present disclosure can be configured such that the at least two intermediate arrangement sections include an intermediate arrangement section adjacent to the front side arrangement section in the longitudinal direction. The intermediate attaching member is arranged on the intermediate arrangement section adjacent to the front side arrangement section.

The shoe of the present disclosure can be configured such that each of the plurality of intermediate attaching members includes a first attaching part arranged on the upper, and a second attaching part arranged on the tightening member. The second attaching part is configured to be detachably attached to the first attaching part. The first attaching part is formed by one of a male member and a female member of a hook-and-loop fastener. The second attaching part is formed by the other of the male member and the female member of the hook-and-loop fastener.

Also, other objects, features, aspects and advantages of the disclosed shoe will become apparent to those skilled in the shoe field from the following detailed description, which, taken in conjunction with the annexed drawings, discloses preferred embodiments of the shoe.

BRIEF DESCRIPTION OF THE DRAWINGS

Referring now to the attached drawings which form a part of this original disclosure.

DETAILED DESCRIPTION OF EMBODIMENTS

A selected embodiment of the present invention will be described with reference to the attached drawings. It will be apparent to those skilled in the shoe field from this disclosure that the following descriptions of the embodiments are provided for illustration only and not for the purpose of limiting the invention as defined by the appended claims and their equivalents.

Figure 1:
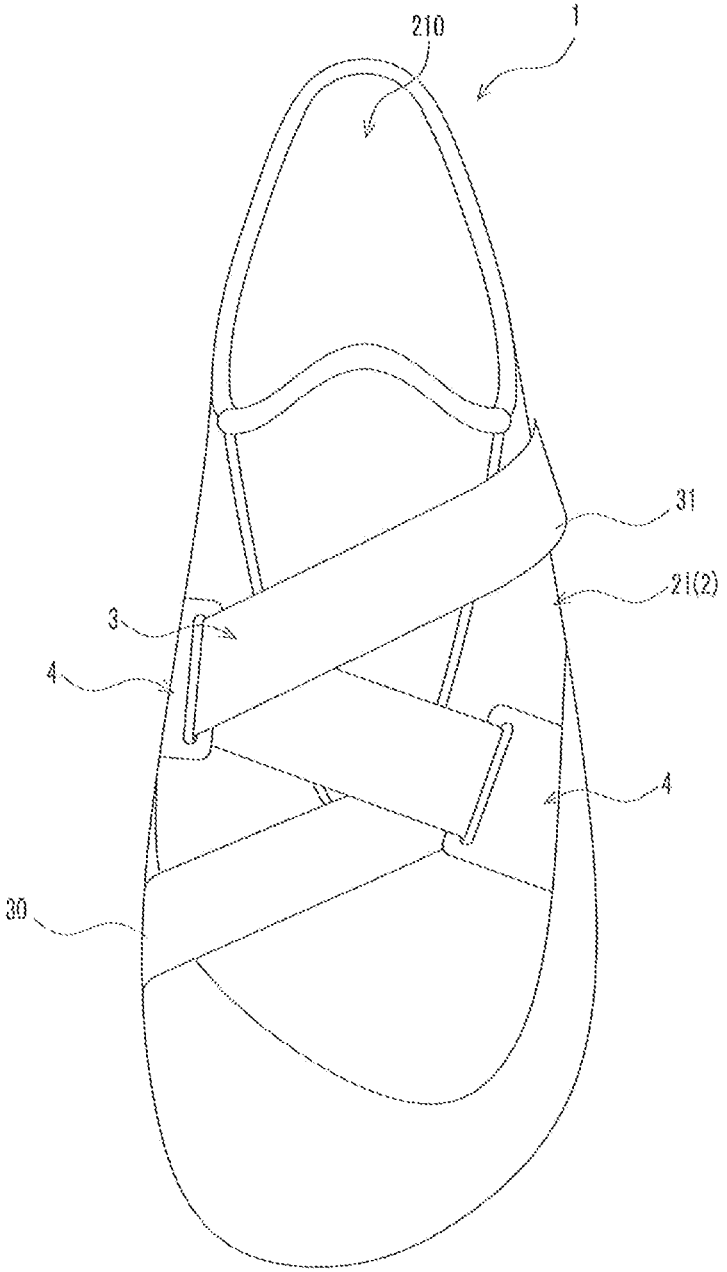
FIG. 1 is a top plan view of a shoe according to one embodiment.
Figure 2:
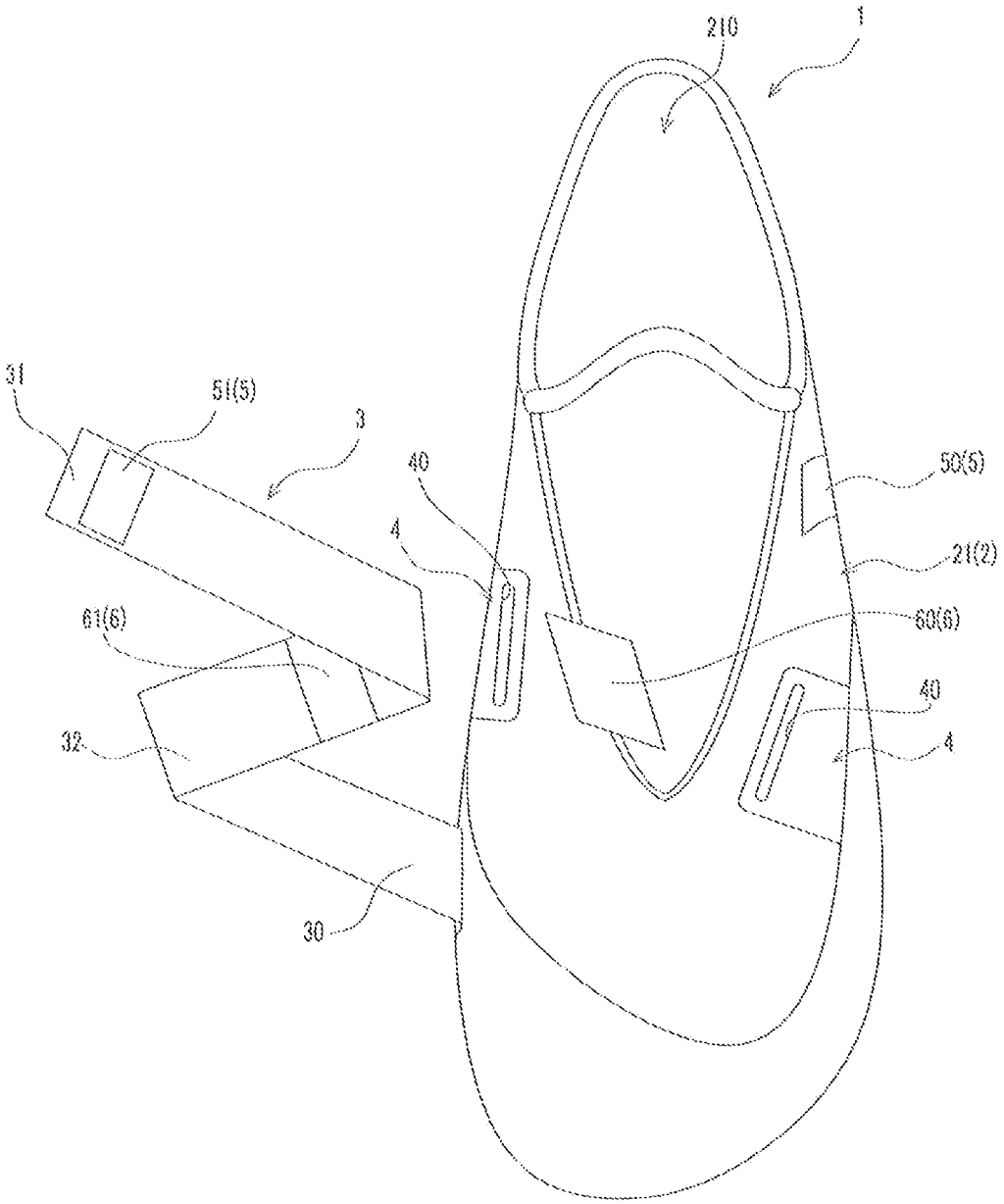
FIG. 2 is a top plan view of the shoe according to the one embodiment with a tightening member detached.
Figure 3A:
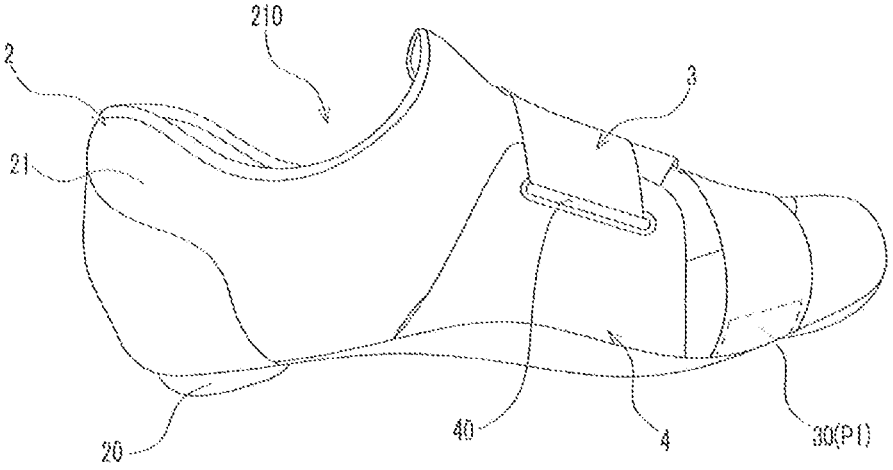
FIG. 3A is a side elevational view of the shoe according to the one embodiment as seen from the medial side.
Figure 3B:
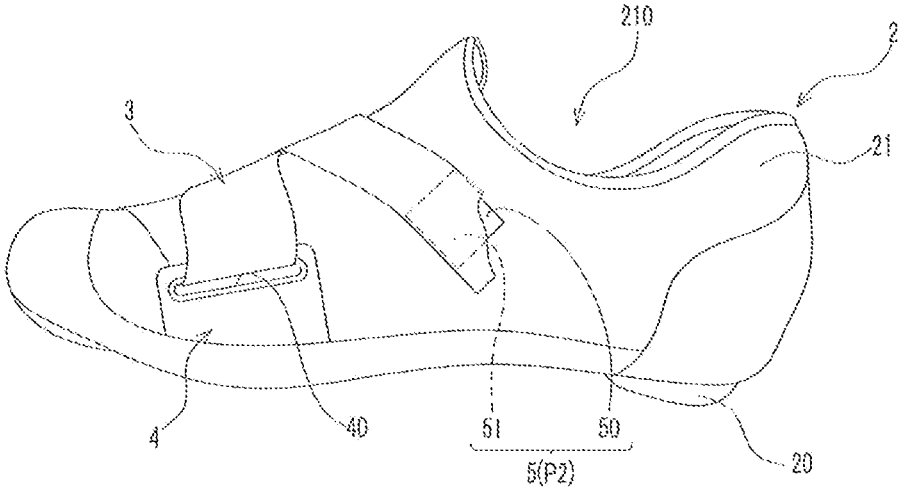
FIG. 3B is a side view of the shoe according to the one embodiment as seen from the lateral side.

Referring to FIG. 1, a shoe 1 is illustrated as a bicycle shoe that is configured to enable a cleat for engagement with a pedal to be attached thereto. However, the shoe 1 is not limited to a bicycle shoe, but rather can be another type of shoe. The shoe 1 basically includes a shoe body 2 including a sole 20 and an upper 21. The upper 21 is disposed on the sole 20 (see FIG. 3A and FIG. 3B). The shoe 1 further includes an elongated tightening member 3 that is configured to apply a tightening force onto a foot of a wearer, which has been fitted into the shoe body 2. The shoe 1 further includes a plurality of hooks 4 provided to the upper 21. The hooks 4 are disposed rearward of an attaching position of a first end 30 of the tightening member 3 relative to the upper 21, and forward of an attaching position of a second end 31 of the tightening member 3 relative to the upper 21. The hooks 4 are configured to enable the tightening member 3 to be wound and hooked to each of the f hooks 4. As shown in FIG. 2, the tightening member 3 has a tail end attaching member 5 for enabling the second end 31 of the tightening member 3 to attach to the upper 21. Also, the tightening member 3 has an intermediate attaching member 6 enabling an intermediate part 32 between the first end 30 and the second end 31 of the tightening member 3 to attach to the upper 21.

The description will be herein given with a direction corresponding to the front and rear of the upper 21 referred to as a longitudinal direction (i.e., a direction in which the heel and the toe are aligned to each other), a direction corresponding to a width of the upper 21 as a width direction, a direction from a width center of the upper 21 toward the lateral side in the width direction (i.e., a direction toward a little toe of the wearer) as a lateral side direction, and a direction from the width center of the upper 21 toward the medial side in the width direction (i.e., a direction toward a big toe of the wearer) as a medial side direction.

The upper 21 is a part for covering the foot of the wearer. The upper 21 has a wearing opening 210 for insertion and removal of the foot of the wearer.

Figure 4:
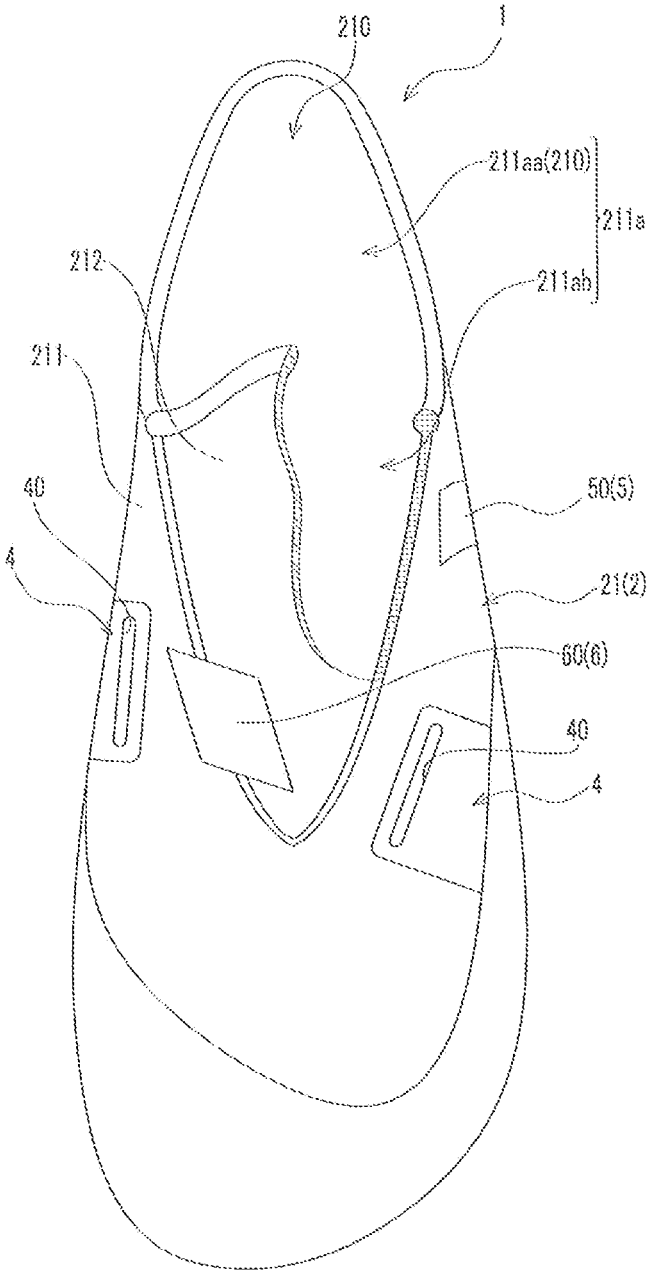
FIG. 4 is a partially cross sectioned view of an upper of the shoe according to the one embodiment with the tightening member removed.

As shown in FIG. 4, the upper 21 includes a base body 211 and a cover fabric 212. The base body 211 forms an opening area 211*a* that opens upward. The cover fabric 212 is sewn to the base body 211. The cover fabric 212 is arranged on a later-described second section of the opening area 211*a*.

The opening area 211*a* includes a first section 211*aa* and a second section 211*ab*. The first section 211*aa* serves as the wearing opening 210. The second section 211*ab* widens from the first section 211*aa* toward the front side in the longitudinal direction.

The cover fabric 212 is a fabric that forms a center section. The cover fabric 212 is sewn to an edge part 211*b* that forms the second section 211*ab* of the base body 211 while being arranged within the second section 211*ab*. The cover fabric (i.e., a tongue) 212 can have a higher stretchability than the base body (i.e., an instep) 211.

As shown in FIG. 2, the tightening member 3 has a band shape. A first end (i.e., head end) 30 of the tightening member 3 attaches to a position located on the front side of the upper 21. The first end 30 of the tightening member 3 is displaced from the width center of the upper 21 toward the medial side (see FIG. 3A). The head end 30 is sewn to the upper 21. That is, the head end 30 attaches to the upper 21 in an inseparable manner.

A second end (i.e., tail end) 31 of the tightening member 3 is configured to be detachably attached to a position located rearward of the head end 30 in the longitudinal direction of the shoe 1. The second end (i.e., tail end) 31 of the tightening member 3 is displaced from the width center of the upper 21 toward the lateral side (see FIG. 3B).

Figure 5A:
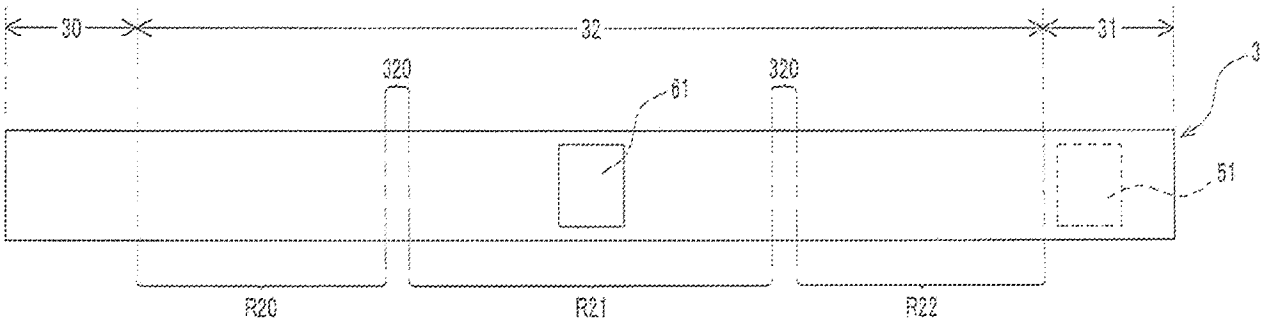
FIG. 5A is an external view of one side of the tightening member of the shoe according to the one embodiment.
Figure 5B:
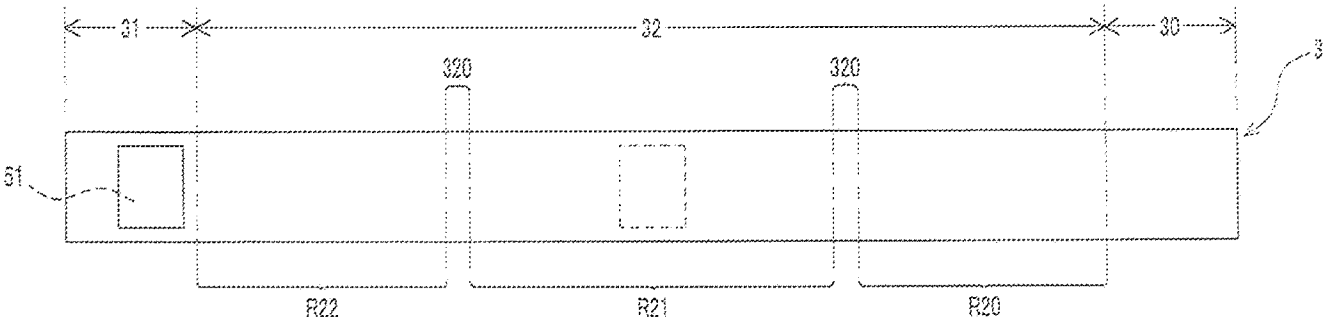
FIG. 5B is an external view of the other side of the tightening member of the shoe according to the one embodiment.

As shown in FIG. 5A and FIG. 5B, the tightening member 3 has an intermediate part 32 between the head end 30 and the tail end 31 of the tightening member 3. The intermediate part 32 includes winding sections 320 that are each configured to be wound and hooked to each of the hooks 4. The tightening member 3 of this embodiment has two winding sections 320 apart from each other in the longitudinal direction of the tightening member 3.

As shown in FIG. 2, the hooks 4 are attached to the edge part 211*b* of the base body 211 (by sewing or the like). Each of the hooks 4 has an eyelet 40 for lacing of the tightening member 3. Since the tightening member 3 of this embodiment has a band shape, the eyelet 40 of each of the hooks 4 has an elongated shape to be in conformity with the shape of the tightening member 3. That is, the eyelets 40 are elongated holes 40.

Two of the hooks 4 are attached to the upper 21 of this embodiment. A first one of the hooks 4 attaches to a position displaced from the width center of the upper 21 toward the lateral side, and a second one of the hooks 4 attaches to a position displaced from the width center of the upper 21 toward a second lateral side that is the medial side. The arrangement positions of the hooks 4 are displaced from each other in the longitudinal direction of the upper 2. Accordingly, the first attaching position of the head end 30 of the tightening member 3, the arrangement positions of the hooks 4, and the second attaching position of the tail end 31 of the tightening member 3 are alternately aligned on the first side and the second side of the upper 2 with the width center of the upper 2 between the first side and the second side of the upper 2.

A tail end attaching member 5 includes a first tail end attaching part 50 and a second tail end attaching part 51. The first tail end attaching part 50 is mounted to the upper 21 on the rear side in the longitudinal direction. The second tail end attaching part 51 is mounted to the tail end 31 of the tightening member 3, and is configured to be detachably attached to the first tail end attaching part 50.

The first tail end attaching part 50 and the second tail end attaching part 51 of this embodiment are formed by a pair of a male member and a female member of a hook-and-loop fastener.

The intermediate attaching member 6 includes a first intermediate attaching part 60 and a second intermediate attaching part 61. The first intermediate attaching part 60 is mounted to a center section of the upper 21. The second intermediate attaching part 61 is mounted to an intermediate part 32 of the tightening member 3, and is configured to be fixable to the first intermediate attaching part 60.

Figure 6:
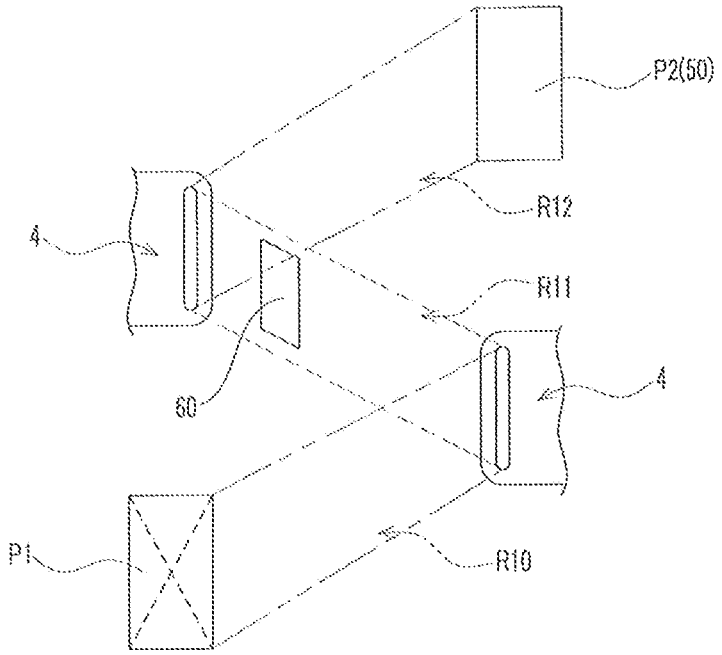
FIG. 6 is a schematic view showing the positional relationship among the tightening member, hooks, a tail end attaching member, and an intermediate attaching member.

As shown in FIG. 6, an arrangement path of the tightening member 3 on the upper 21 includes a front side arrangement section R10, an intermediate arrangement section R11 and a rear side arrangement section R12. The front side arrangement section R10 is between an attaching position P1 of the head end 30 and the hook 4 located at a foremost position in the longitudinal direction among the hooks 4. The intermediate arrangement section R11 is between adjacent two of the hooks 4. The rear side arrangement section R12 is between an attaching position of the tail end 31 and the hook 4 located at a rearmost position in the longitudinal direction among the hooks 4.

The first intermediate attaching part 60 is arranged on the intermediate arrangement section R11 among the three sections, namely, the front side arrangement section R10, the intermediate arrangement section R11, and the rear side arrangement section R12.

As shown in FIG. 5A and FIG. 5B, the tightening member 3 includes a head end side section R20, an intermediate section R21 and a tail end side section R22. The head end side section R20 is between the head end 30 and the winding position closest to the head end 30 among the winding positions. The intermediate section R21 is between the adjacent winding positions (two adjacent winding positions in this embodiment). The tail end side section R22 is between the tail end 31 and the winding position closest to the tail end 31 among the winding positions.

The head end side section R20 is arranged in the front side arrangement section R10. The intermediate section R21 is arranged in the intermediate arrangement section R11. The tail end side section R22 is arranged in the rear side arrangement section R12.

The second intermediate attaching part 61 is arranged on the intermediate arrangement section R11 that is closest to the head end side section R20 among the three sections, namely, the head end side section R20, the intermediate section R21, and the tail end side section R22.

The configuration of the shoe 1 according to this embodiment is as described above. Next, the description will be given on how to wear the shoe.

Figure 7C:
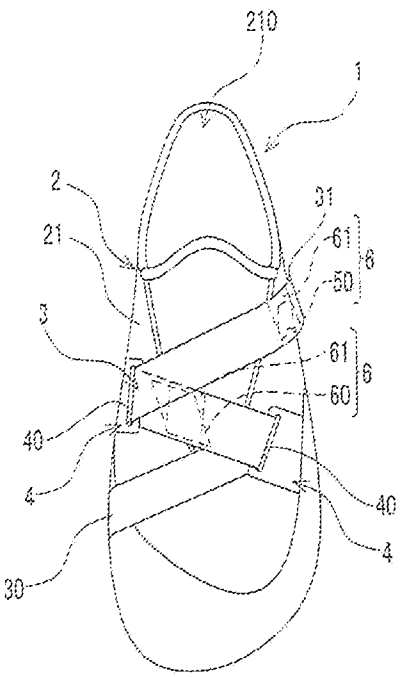
FIG. 7C is an explanatory view showing how to wear the shoe according to the one embodiment in the state where a tail end of the tightening member attaches to the upper.
Figure 7B:
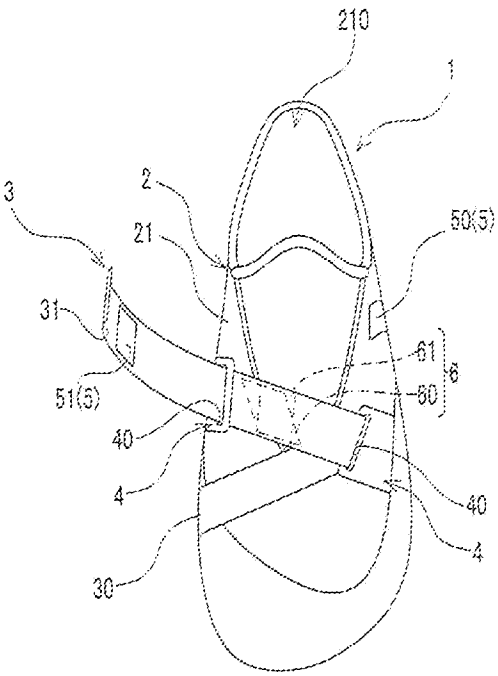
FIG. 7B is an explanatory view showing how to wear the shoe according to the one embodiment in the state where a second intermediate attaching part attaches to a first intermediate attaching part, and thereafter the tightening member is laced through the eyelet of the remaining hook.
Figure 7A:
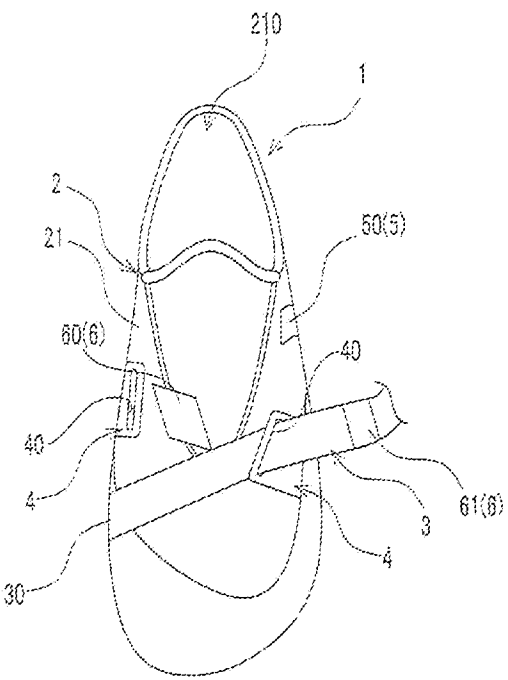
FIG. 7A is an explanatory view showing how to wear the shoe according to the one embodiment, in which the tightening member is laced through an eyelet of a foremost hook.

The wearer puts his or her foot into the shoe body 2 through the wearing opening 210, and then laces the tightening member 3 through the eyelet 40 of the hook 4 located at the foremost position in the longitudinal direction (see FIG. 7A).

Then, the winding position of the tightening member 3 is hooked at the hook 4 and then turned back. Then the tightening member 3 is pulled to such an extent that a tightening force suitable to the foot is caused, and then the second intermediate attaching part 61 attaches to the first intermediate attaching part 60 while maintaining the application of the appropriate tightening force (see FIG. 7B). In this way, the tightening member 3 is prevented from loosening. Thereby, it is possible to maintain the application of the tightening force suitable to the area of the foot, which corresponds to the area of the shoe between the attaching position of the head end 30 and the attaching position of the tail end 31 (i.e., the position of the first tail end attaching part 50).

Then, the tightening member 3 is laced through the eyelets 40 of the remaining hooks 4, then, the tightening member 3 is pulled to such an extent that a tightening force suitable to the foot is caused. Then the tail end 31 attaches to the upper 21 while maintaining the application of the appropriate tightening force (see FIG. 7C). In this way, the tightening member 3 is prevented from loosening. Thereby, it is possible to maintain the application of the tightening force suitable to the area of the foot, which corresponds to the area of the shoe between the position of the first intermediate attaching part 60 and an attaching position P2 of the tail end 31.

As described above, according to the shoe 1 of this embodiment, the part between the head end 30 and the tail end 31 of the tightening member 3 can attach to the upper 21 by the intermediate attaching member 6. Thus, even before the tail end 31 attaches to the upper 21, it is possible to enable application of the tightening force to the foot by pulling the tightening member 3, and attaching of the tightening member 3 to the upper 21 while maintaining the application of the tightening force to the foot.

The above configuration enables, in a stepwise manner, application of the tightening force to the foot by pulling the tightening member 3 and attaching of the tightening member 3 to the upper 21 while maintaining the application of the tightening force to the foot, and thus enables easy adjustment of the tightening force to be applied to the foot.

Since the intermediate attaching member 6 is disposed in the intermediate arrangement section R11 adjacent to the front side arrangement section R10 in the longitudinal direction, the tightening member 3 can attach to the upper 21 after the tightening member 3 is wound through the eyelet 40 of the one of the hooks 4, which is closest to the front side, and hooked to the hook 4. Thereby, the tightening force to be applied to the toe of the wearer can be easily adjusted, and the adjusted tightening force can be easily maintained.

Further, according to the shoe 1 of this embodiment, only one tightening member 3 is provided so that the shoe 1 has a simple structure and makes it easy to adjust the tightening force to be applied to the foot.

Further, since the adjustment of the tightening force is enabled by only pulling one tightening member 3, the tightening member 3 can be instantly retightened. Thus, for example, in the case where the shoe 1 is a bicycle shoe configured to enable a cleat for engagement with a pedal to be attached thereto, the wearer can instantly retighten the tightening member 3 by a single hand even when he or she is riding on the bicycle.

Further, the tightening member 3 of this embodiment having a belt shape has a large area to be in contact with the upper so that the tightening force applied to the foot can be easily increased.

The tightening member 3 having a belt shape enables the hook-and-loop fastener to be attached thereto, and the intermediate attaching member 6 includes the first intermediate attaching part 60 and the second intermediate attaching part 61 respectively formed by the pair of the male member and the female member of the hook-and-loop fastener. Accordingly, attachment of the second intermediate attaching part 61 to the first intermediate attaching part 60 and detachment of the second intermediate attaching part 61 from the first intermediate attaching part 60 can be easily performed, and the surface engagement between the first intermediate attaching part 60 and the second intermediate attaching part 61 enables the application of the tightening force to be easily maintained.

Thus, the shoe 1 of this embodiment having a simple structure enables the tightening force to be easily applied to the foot of the wearer.

The shoe 1 of the present invention is not limited to the above embodiment, and it is a matter of course that the shoe 1 can be subjected to various modifications without departing the gist of the present invention.

Although not mentioned in the above embodiment, the shoe 1 can be any type of shoe in addition to the bicycle shoe.

In the above embodiment, the tightening member 3 has a band shape, but this is not essential. For example, the tightening member 3 can have a string shape.

The tightening member 3 of the above embodiment is formed by a single piece, but this is not essential. For example, the tightening member 3 may be formed by a plurality of pieces, which are connected together to form a single elongated member. Thus, the tightening member 3 can consists of a single tightening member made of several pieces together to form a single elongated member.

The tightening member 3 of the above embodiment has the head end 30 attaching to the upper 21 by sewing, but this is not essential. For example, the tightening member 3 can attach to the upper 21 by bonding, welding or any other methods. In the same manner as the head end 30 of the tightening member 3, the hooks 4 can attach to the upper 21 by bonding, welding, or any methods other than sewing.

Figure 8:
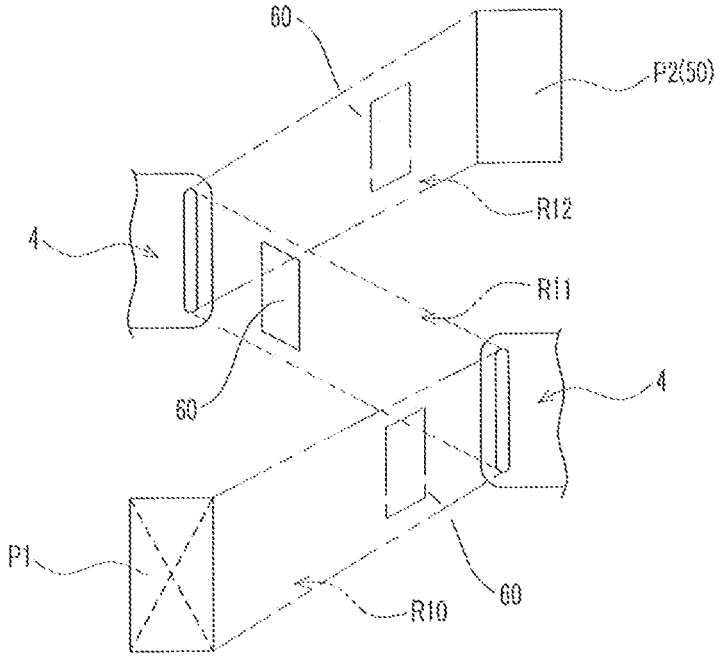
FIG. 8 is an explanatory view of a shoe according to another embodiment of the present invention, showing an arrangement form of first intermediate attaching parts.

According to the arrangement path of the above embodiment, the first intermediate attaching part 60 of the intermediate attaching member 6 is arranged only in the intermediate arrangement section R11 among the front side arrangement section R10, the intermediate arrangement section R11, and the rear side arrangement section R12, but this is not essential. For example, as shown in FIG. 8, the first intermediate attaching part 60 can be also arranged on each of the front side arrangement section R10 and the rear side arrangement section R12.

It can be configured such that the first intermediate attaching part 60 is not arranged on the intermediate arrangement section R11, while being arranged on the front side arrangement section R10 or the rear side arrangement section R12, or the first intermediate attaching part 60 is arranged on each of the front side arrangement section R10 and the rear side arrangement section R12. That is, it is essential that the intermediate attaching member 6 be arranged on at least one of the front side arrangement section R10, the intermediate arrangement section R11, and the rear side arrangement section R12.

Figure 9A:
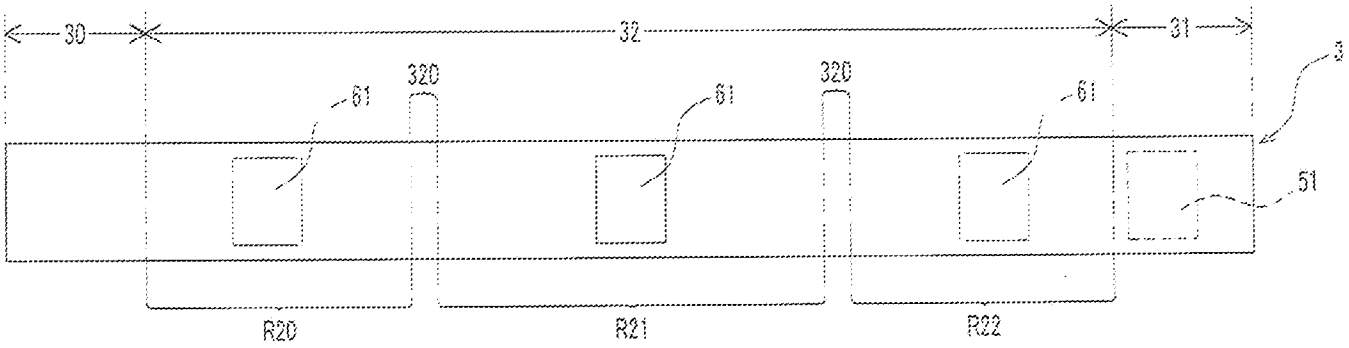
FIG. 9A is an explanatory view of the shoe according to the embodiment of FIG. 8, showing an arrangement form of second intermediate attaching parts.
Figure 9B:
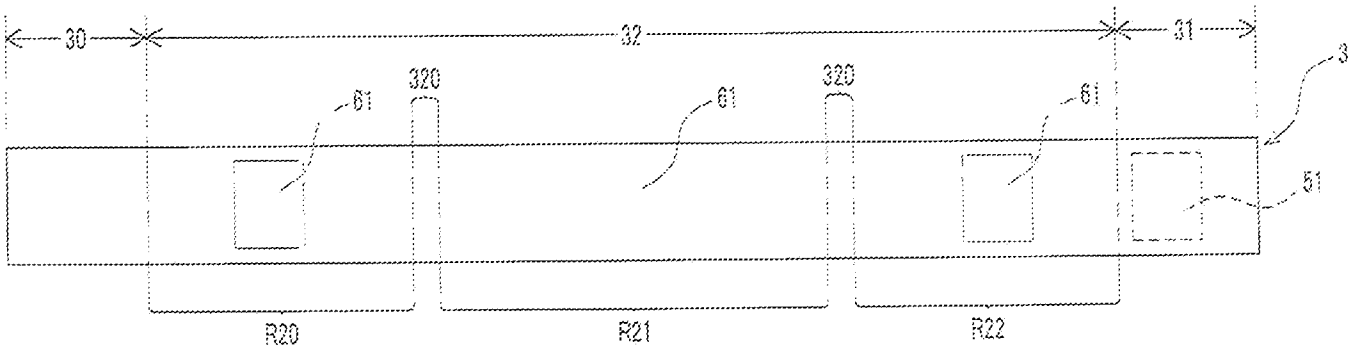
FIG. 9B is an explanatory view of the shoe according to still another embodiment, showing an arrangement form of the second intermediate attaching parts.

Even in the arrangement of the second intermediate attaching part 61 in the intermediate section R21 (i.e., the arrangement of the first intermediate attaching part 60 in the intermediate arrangement section R11) as shown in FIG. 9A and even in the non-arrangement of the second intermediate attaching part 61 in the intermediate section R21 (i.e., the non-arrangement of the first intermediate attaching part 60 in the intermediate arrangement section R11) as shown in FIG. 9B, it is necessary to arrange the second intermediate attaching part 61 in the head end side section R20 when the first intermediate attaching part 60 is arranged on the front side arrangement section R10, and arrange the second intermediate attaching part 61 in the tail end side section R22 when the first intermediate attaching part 60 is arranged on the rear side arrangement section R12.

Figure 10:
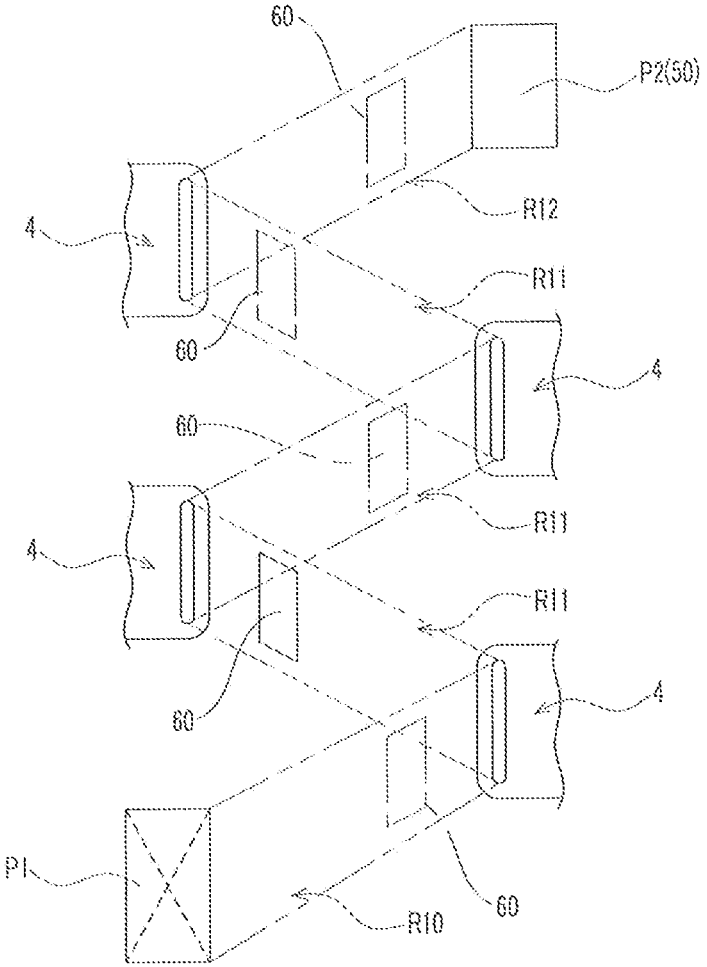
FIG. 10 is an explanatory view of the shoe according to yet another embodiment of the present invention, showing an arrangement form of the first intermediate attaching parts.

The arrangement path of the above embodiment includes one intermediate arrangement section R11, but this is not essential. For example, as shown in FIG. 10, the arrangement path can include a plurality of intermediate arrangement sections R11. That is, the arrangement path can include one or more intermediate arrangement sections R11 according to the number of the hooks 4.

In the case where the arrangement path includes a plurality of intermediate arrangement sections R11, one of the intermediate arrangement sections R11 is arranged at a position located close to the front side arrangement section R10 in the longitudinal direction, so that the tightening force on the front side can be easily adjusted.

Figure 11A:
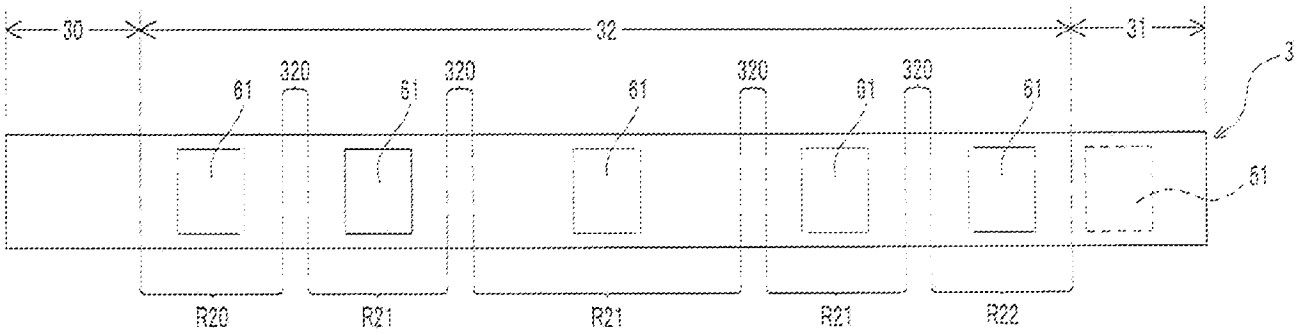
FIG. 11A is an explanatory view of the shoe according to the embodiment of FIG. 10, showing an arrangement form of the second intermediate attaching parts.
Figure 11B:
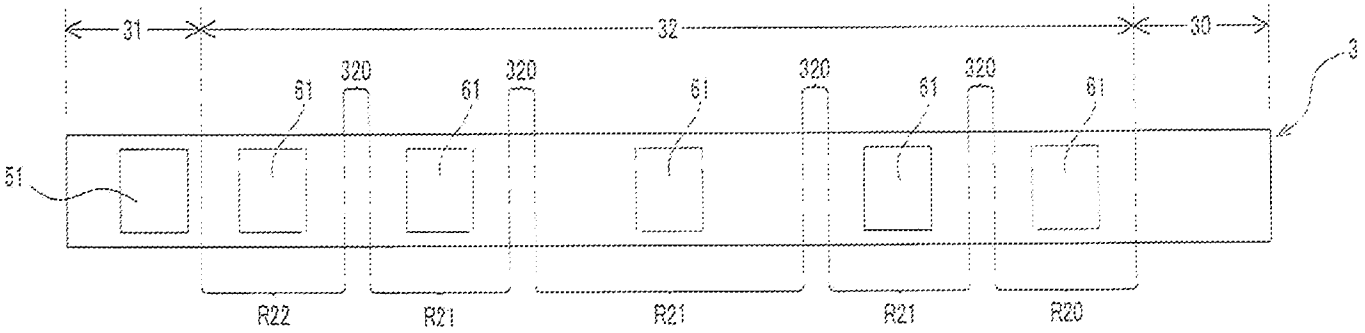
FIG. 11B is an explanatory view of the shoe according to the embodiment of FIG. 10, showing an arrangement form of the second intermediate attaching parts.

In the case where the arrangement path includes a plurality of intermediate arrangement sections R11, the tightening member 3 includes a plurality of intermediate sections R21 as shown in FIG. 11. That is, the tightening member 3 also includes one or more intermediate sections R21 according to the number of the hooks 4.

In the case where the first intermediate attaching part 60 is mounted to the intermediate arrangement section R11 that is closest to the front side arrangement section R10 in the longitudinal direction, it is essential that the second intermediate attaching part 61 be mounted to the intermediate arrangement section R11 that is closest to the head end 30.

Figure 12:
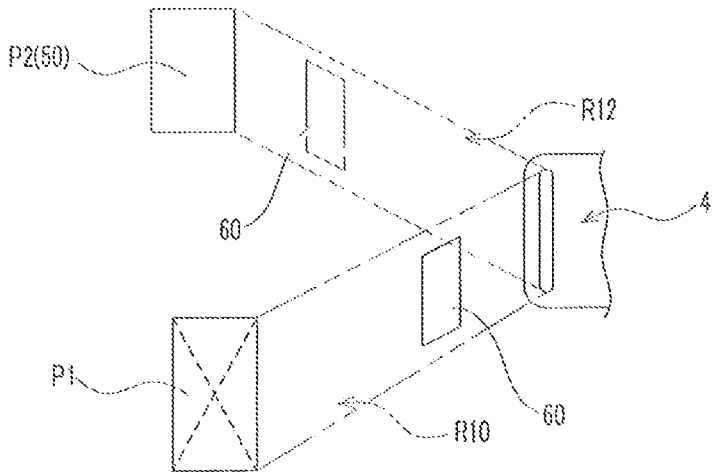
FIG. 12 is an explanatory view of the shoe according to still further another embodiment of the present invention, showing an arrangement form of the first intermediate attaching parts.

The arrangement path of the above embodiment includes one intermediate arrangement section R11, but this is not essential. For example, as shown in FIG. 12, the arrangement path may not include the intermediate arrangement section R11. Thus, there is a case where the arrangement path does not include the intermediate arrangement section R11, which depends on the number of the hooks 4.

In the case where the arrangement path does not includes the intermediate arrangement section R11, the tightening member 3 also does not include the intermediate arrangement section R11. That is, there is a case where the tightening member 3 does not include the intermediate arrangement section R11, which depends on the number of the hooks 4.

Figure 13A:
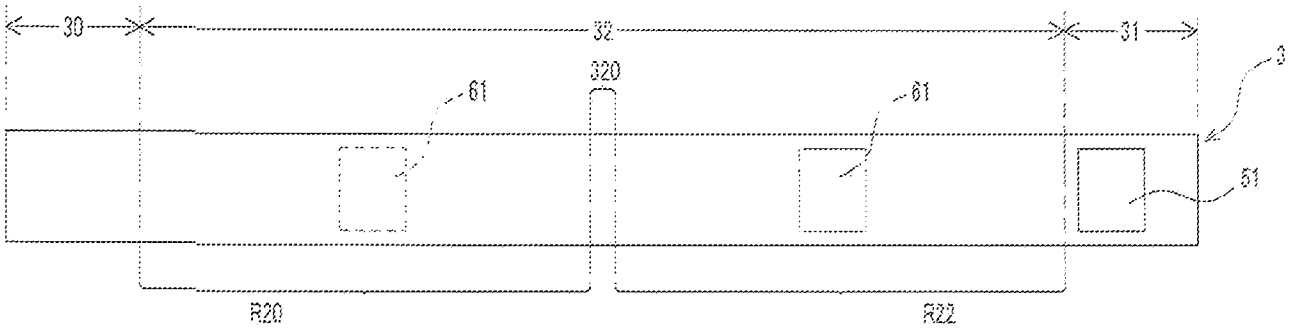
FIG. 13A is an explanatory view of the shoe according to the embodiment of FIG. 12, showing an arrangement form of the second intermediate attaching parts.
Figure 13B:
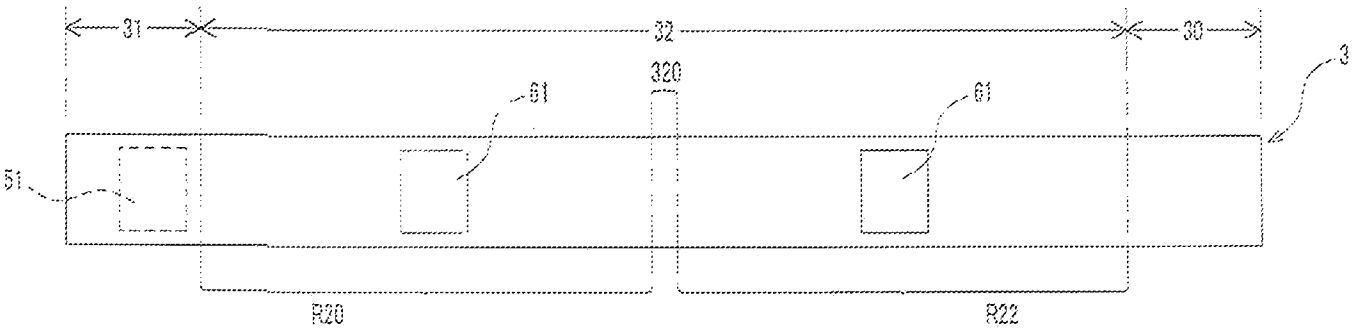
FIG. 13B is an explanatory view of the shoe according to the embodiment of FIG. 12, showing an arrangement form of the second intermediate attaching parts.

In this case, it is essential that the first intermediate attaching part 60 be mounted to the front side arrangement section R10 or the rear side arrangement section R12 as shown in FIG. 12, and the second intermediate attaching part 61 be mounted to the head end side section R20 or the tail end side section R22 as shown in FIG. 13. When the first intermediate attaching part 60 is mounted to the front side arrangement section R10 and the second intermediate attaching part 61 is mounted to the head end side section R20, the adjustment of the tightening force on the toe side can be easily made.

In the above embodiment, the first tail end attaching part 50 and the second tail end attaching part 51 of the tail end attaching member 5 are formed by the pair of the male member and the female member of the hook-and-loop fastener, but this is not essential. For example, as long as the tail end attaching member 5 is configured to enable the adjustment of the tightening force of the tightening member 3 applied to the foot and enable the maintaining of the adjusted state of the tightening force, any other configuration (e.g., a dial type winder) can be adopted.

In the above embodiment, the first intermediate attaching part 60 and the second intermediate attaching part 61 of the intermediate attaching member 6 are formed by the pair of the male member and the female member of the hook-and-loop fastener, but this is not essential. For example, as long as the intermediate attaching member 6 is configured to enable the adjustment of the tightening force of the tightening member 3 applied to the foot and enable the maintaining of the adjusted state of the tightening force, any other configuration (e.g., a button and a hook) may be adopted.

The shoe of the present invention is described above by way of the above embodiments, but is not limited to the aforementioned embodiments. Thus, the shoe according to the present invention can be subjected to various modifications within the intended scope of the present invention. Further, the operation and effect of the present invention are not limited to the above embodiments. That is, the embodiments disclosed herein should be considered to be illustrative in all respects and not restrictive. The scope of the present invention is indicated by the appended claims, not by the above description. It is also contemplated that the scope of the present invention includes all modifications within the meaning and scope of equivalence to the claims.

What is claimed is:

1. A shoe comprising:

a shoe body including a sole and an upper mounted on the sole;

an elongated tightening member having a first end, a second end and an intermediate part between the first end and the second end, the first end being attached to a first attaching position located on a front side of the upper with respect to a longitudinal direction of the upper, the second end being configured to be detachably attached to a second attaching position located rearward of the first end with respect to the longitudinal direction;

a plurality of eyelets located rearward of the first attaching position and forward of the second attaching position, each of the plurality of eyelets being configured for the tightening member to be laced there-through; and an intermediate attaching member that is located rearward of the first attaching position and forward of the second attaching position, the intermediate attaching member being configured to enable the intermediate part of the tightening member to be fixed to the upper and prevented from loosening, the intermediate attaching member being located between a pair of adjacent eyelets among the plurality of eyelets.

2. The shoe according to claim 1, wherein the tightening member is a single tightening member.

3. The shoe according to claim 2, wherein the intermediate attaching member is made up of a plurality of intermediate attaching members.

4. The shoe according to claim 1, wherein the intermediate attaching member is made up of a plurality of intermediate attaching members.

5. The shoe according to claim 1, wherein the intermediate attaching member includes a first attaching part arranged on the upper, and a second attaching part arranged on the tightening member, the second attaching part is configured to be detachably attached to the first attaching part;

the first attaching part is formed by one of a male member and a female member of a hook-and-loop fastener; and the second attaching part is formed by the other of the male member and the female member of the hook-and-loop fastener.

6. The shoe according to claim 1, wherein each of the plurality of intermediate attaching members includes a hook-and-loop fastener.

7. The shoe according to claim 6, wherein the hook-and-loop fastener comprises a first attaching part arranged on the upper and a second attaching part arranged on the tightening member, the first attaching part being formed by one of a male member and a female member of the hook-and-loop fastener, and the second attaching part being formed by the other of the male member and the female member of the hook-and-loop fastener.

8. The shoe according to claim 1, wherein the intermediate attaching member includes a button-and-hook fastener.

9. The shoe according to claim 1, wherein the intermediate attaching member includes a plurality of intermediate attaching members, each of the plurality of intermediate attaching members being located between a different pair of adjacent eyelets among the plurality of eyelets.

10. The shoe according to claim 9, wherein the pair of adjacent eyelets includes a first eyelet and a second eyelet that are spaced apart from each other in widthwise direction of the upper, the widthwise direction being substantially perpendicular to the longitudinal direction.

11. The shoe according to claim 9, wherein each different pair of adjacent eyelets includes a first eyelet and a second eyelet that are spaced apart from each other in widthwise direction of the upper, the widthwise direction being substantially perpendicular to the longitudinal direction.

12. A shoe comprising:

a shoe body including a sole and an upper mounted on the sole;

an elongated tightening member having a first end, a second end and an intermediate part between the first end and the second end, the first end being attached to a first attaching position located on a front side of the upper with respect to a longitudinal direction of the upper, the second end being configured to be detachably attached to a second attaching position located rearward of the first end with respect to the longitudinal direction;

a plurality of eyelets located at a plurality of arrangement positions that are disposed rearward of the first attaching position and forward of the second attaching position, each of the plurality of eyelets being configured for the tightening member to be laced there-through; and an intermediate attaching member that is located rearward of the first attaching position and forward of the second attaching position, the intermediate attaching member being configured to enable the intermediate part of the tightening member to be fixed to the upper and prevented from loosening;

the first attaching position, the plurality of arrangement positions, and the second attaching position being disposed alternately on a first side and a second side of a widthwise center of the upper, an arrangement path of the tightening member including a front side arrangement section, at least one intermediate arrangement section, and a rear side arrangement section, the front side arrangement section being disposed between the first attaching position and one of the plurality of eyelets located at a frontmost position among the plurality of eyelets in the longitudinal direction, the at least one intermediate arrangement section being disposed between two adjacent ones of the arrangement positions of the plurality of eyelets, and the rear side arrangement section being between the second attaching position and another of the plurality of eyelets located at a rearmost position among the plurality of eyelets in the longitudinal direction; and the intermediate attaching member is arranged on at least one of the front side arrangement section, the at least one intermediate arrangement section, and the rear side arrangement section.

13. The shoe according to claim 12, wherein the at least one intermediate arrangement section includes an intermediate arrangement section adjacent to the front side arrangement section in the longitudinal direction; and the intermediate attaching member is arranged on the intermediate arrangement section adjacent to the front side arrangement section.

14. The shoe according to claim 12, wherein the plurality of eyelets includes at least three eyelets;

the at least one intermediate arrangement section includes at least two intermediate arrangement sections;

the intermediate attaching member is made up of a plurality of intermediate attaching members; and each of the plurality of intermediate attaching members is arranged on each of the at least two intermediate arrangement sections.

15. The shoe according to claim 14, wherein the at least two intermediate arrangement sections include an intermediate arrangement section adjacent to the front side arrangement section in the longitudinal direction; and at least one intermediate attaching member along the plurality of intermediate attaching members is arranged on the intermediate arrangement section adjacent to the front side arrangement section.

16. The shoe according to claim 14, wherein each of the plurality of intermediate attaching members comprises a first attaching part arranged on the upper, and a second attaching part arranged on the tightening member, the second attaching part is configured to be detachably attached to the first attaching part;

the first attaching part is formed by one of a male member and a female member of a hook-and-loop fastener; and the second attaching part is formed by the other of the male member and the female member of the hook-and-loop fastener.

17. A shoe comprising:

a shoe body including a sole and an upper mounted on the sole;

an elongated tightening member having a first end, a second end and an intermediate part between the first end and the second end, the first end being attached to a first attaching position located on a front side of the upper with respect to a longitudinal direction of the upper, the second end being configured to be detachably attached to a second attaching position located rearward of the first end with respect to the longitudinal direction;

a plurality of hooks including at least three hooks, the plurality of hooks being located rearward of the first attaching position and forward of the second attaching position, each hook of the plurality of hooks being configured to enable the tightening member to be wound and hooked thereto; and a plurality of intermediate attaching members, each of the plurality of intermediate attaching members being configured to enable the intermediate part of the tightening member to be attached to the upper, the first attaching position, the plurality of hooks, and the second attaching position being disposed alternately on a first side and a second side of a widthwise center of the upper, an arrangement path of the tightening member including a front side arrangement section, a plurality of intermediate arrangement sections, and a rear side arrangement section, the front side arrangement section being disposed between the first attaching position and one of the plurality of hooks located at a frontmost position among the plurality of hooks in the longitudinal direction, each of the plurality of intermediate arrangement sections being disposed between two adjacent hooks among the plurality of hooks, and the rear side arrangement section being between the second attaching position and another of the plurality of hooks located at a rearmost position among the plurality of hooks in the longitudinal direction, each of the plurality of intermediate attaching members being arranged on each of the plurality of intermediate arrangement sections, and each of the plurality of intermediate attaching members comprising a first attaching part arranged on the upper and a second attaching part arranged on the tightening member, the second attaching part being configured to be detachably attached to the first attaching part, wherein the first attaching part is formed by one of a male member and a female member of a hook-and-loop fastener, and the second attaching part is formed by the other of the male member and the female member of the hook-and-loop fastener.

* * * * *